United States Patent [19]

Sandell

[11] Patent Number: 4,550,363

[45] Date of Patent: Oct. 29, 1985

[54] CANDLE SIMULATING LIGHT BULB COVER

[76] Inventor: Sven Sandell, Kälkbacksgatan 5, S-552 62 Jönköping, Sweden

[21] Appl. No.: 652,031

[22] Filed: Sep. 19, 1984

[30] Foreign Application Priority Data

Sep. 21, 1983 [SE] Sweden ..... 8305082

[51] Int. Cl.[4] ..... F21V 11/00

[52] U.S. Cl. ..... 362/806; 362/351; 362/362; D26/134

[58] Field of Search ..... 362/351, 362, 363, 806, 362/808, 161; 431/125; D26/125, 128, 5, 133, 134, 136, 96

[56] References Cited

U.S. PATENT DOCUMENTS

D. 10,251 9/1877 Dithridge ..... D26/134
D. 32,529 4/1900 Stenz ..... D26/134
D. 40,625 4/1810 Booth ..... D26/134
D. 82,131 9/1930 Brady ..... D26/128
3,662,165 5/1972 Osteen ..... 362/363

FOREIGN PATENT DOCUMENTS 543497 7/1957 Canada ..... 262/351

*Primary Examiner*—Ronald H. Lazarus
*Attorney, Agent, or Firm*—Sughrue, Mion, Zinn, Macpeak and Seas

[57] ABSTRACT

To simulate a candle flame an electric-light bulb (15) is fitted with a light-permeable and light-scattering lamp casing (1). Arranged on the inner surface (5) of the lamp casing are spacing elements (6,7,8) which hold the outer surface (14) of the light bulb (15) spaced from the inner surface (5) of the lamp casing (1). The lamp casing (1) is open at both ends, and cooling air is conducted along the inner surface of the lamp casing by convection.

8 Claims, 4 Drawing Figures

CANDLE SIMULATING LIGHT BULB COVER

BACKGROUND OF THE INVENTION

The invention relates to an electric lamp arrangement intended as an imitation candle.

Imitation candles are well known and normally comprise a substantially cylindrical body, which is intended to give the impresssion of the stearine or wax body of a true candle, and an electric-light bulb intended, when switched on, to give the illusion of a candle flame.

Although it is possible to produce perfect imitations of the candle body or casing itself, it has not been possible hitherto to produce an acceptable imitation of a candle flame. Attempts have been made to give the glass envelope of the bulb a design which resembles a candle flame, and to produce a bulb which emits a "flickering" light. The illusion thus created, however, has been a very poor imitation of a real candle. In recent years attempts have been made to suspend the bulb on a coil spring and to connect the bulb to a magnetizable counterweight which is periodically acted upon by a magnetic field. Although the effect afforded by these attempts is an improvement on the arrangement employing rigidly mounted bulbs, the results have not been found acceptable, and in addition the imitation candles thus produced give off an irritating sound, such as a clicking sound for example, when the counterweight is drawn against the electric coil generating the magnetic field.

Consequently, it has been decided that the only possible way of producing an electric-light bulb which gives a satisfactory imitation of a candle flame is to design the bulb in such a way that the effect desired is produced by the bulb itself. Lamp-bulb designs created along these lines have mainly involved making the actual glass envelopes of the bulbs by hand, and then manually colouring the envelopes thus produced. Such bulbs are particularly expensive, partly because of the manual labour required and partly because of the relatively low demand for such bulbs. Consequently, the finished product is practically unsaleable.

SUMMARY OF THE INVENTION

It is therefore a prime object of the invention to provide a simple and inexpensive arrangement which can be used together with mass produced electric-light bulbs of the kind employed with instrument lighting systems for example, and which causes the bulbs to give an illusion of a candle flame.

BRIEF DESCRIPTION OF THE DRAWINGS

This object is fully achieved with the arrangement defined in the following claims and described hereinafter with reference to the accompanying drawing, in which

DETAILED DESCRIPTION OF THE PREFERRED EMBODIMENTS

Figure 1:
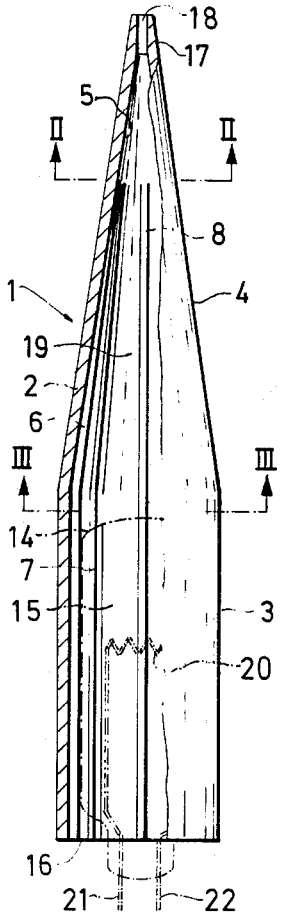
FIG. 1 is a simplified axial part-sectional view of a preferred embodiment of the invention fitted around an electric-light bulb.
Figure 2:
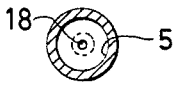
FIG. 2 is a sectional view taken on the line II—II in FIG. 1.
Figure 3:
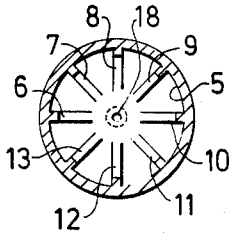
FIG. 3 is a sectional view taken on the line III—III in FIG. 1.

FIG. 1 illustrates a lamp casing 1 which has a wall 2 of substantially uniform thickness. The lamp casing 1, which is shown in FIG. 1 on a scale of 5:1, comprises a lower, substantially cylindrical part 3, which merges smoothly with an upper part 4 having the shape of a right-circular cone. In the illustrated embodiment the conical part 4 has an apex angle of about 18°, although it will be understood that this angle can be varied. Thus, the lamp casing 1 illustrated in FIG. 1 is rotationally symmetrical about its vertical long axis. The inner wall 5 of the lamp casing 1 is provided with ridges or flanges 6,7,8,9,10,11,12 and 13 which extend parallel with the aforesaid long axis. Each such flange has a radial extension of about 0.4 mm and the cylindrical part 3 has an internal diameter of about 7.6 mm. These flanges 6–13, which are uniformly distributed around the inner wall 5 of the casing 1 and extend longitudinally into the conical part 4 of the illustrated embodiment, form spacing elements which are intended to lie against the outer surface 14 of an electric-light bulb 15, which in the illustrated embodiment is assumed to comprise a cylindrical glass envelope. The lower end 16 of the lamp casing 1 is fully open and has a base diameter larger than the largest diameter of the bulb 15, and its upper end 17, formed by the pointed portion of the conical part 4, is provided with a throughpassing hole 18 which communicates with the interior cavity 19 of the lamp casing 1.

Thus, when the bulb 15, which has arranged therein a filament 20 and conductors or electrodes 21 and 22 connected thereto, is inserted in the casing 1, free air passages which extend from the lower end 16 to the upper hole 18 are formed between the outer surface of the light bulb 15 and the inner wall 5 of the lamp casing. The heat generated by the lamp 15 will therefore be carried away by an upwardly moving flow of air, and heating of the lamp casing will be at a minimum. Consequently, the lamp casing 1 can be made of a material which while being suitable for the purpose is also slightly sensitive to heat, such as soft PVC-plastic, HD-polyethylene or the like, for example. The material from which the lamp casing is made shall be permeable to light and shall also scatter the light shining thereonto, so as to obtain diffuse light emission. None-clear or translucent plastics have been found suitable for this purpose. So that the light emitted from the lamp casing and generated by a light bulb of, for example, 1–3 watts, shall resemble as far as possible, the light emitted by a candle flame, the upper part of the casing 1 shall have a higher light intensity than the lower part. Such an effect can be produced by colouring the cylindrical lower part 3 of the casing with, for example, a grey light-absorbing pigment. Alternatively, the effect desired can also be achieved by varying the wall thickness of the lamp casing.

In addition to forming part of the aforedescribed cooling system, the hole 18 also has the important function of permitting the casing to expand and contract without cracking or splitting. The narrow hole 18, constitutes a light conducting channel directed upwardly and having an axis substantially coaxial with the longitudinal axis of the casing 1. The effect of the hole is that a narrow light cone will be directed to a crystal prism, for example, arranged above the casing 1.

Figure 4:
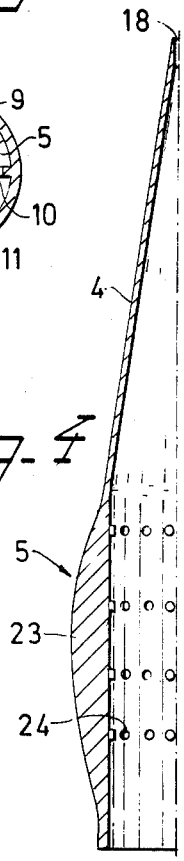
FIG. 4 illustrates a section of the wall of a modified lamp casing.

Another embodiment is illustrated in FIG. 4. In this embodiment, the wall of the upper conical part 4 is thinner than the upper conical wall of the FIG. 1 embodiment, while the wall of the lower, cylindrical part is much thicker. Thus, light emitted from the bulb will be dampened far more strongly in the lower part of the lamp than in the upper part thereof. In the FIG. 4 embodiment, the spacing elements on the inner wall 5 of the lamp casing have the form of beads or warts, such as the beads 23 and 24, arranged to hold the outer surface of the light bulb spaced from the inner wall of the lamp casing, thereby to provide said ventilation of the casing interior.

As will be understood, the aforesaid optional colouring of the light-permeable material need not necessarily be effected with a grey pigment, but can be done with any colour suitable for the purpose.

In the aforegoing it has been assumed that the glass envelope of the light bulb has a cylindrical shape. Bulbs having envelopes of other shapes, such as spherical or conical shapes for example, can be used equally as well, however. If the material from which the lamp casing is made is unable to scatter light to the extent desired, by which is meant so that a somewhat diffuse light is emitted from the casing, the outer or inner surface of the lamp can be roughened in some suitable manner.

I claim:

1. An electric lamp arrangement for simulating a burning candle flame, comprising: an electric light bulb (15) having a generally cylindrical portion, an elongated lamp casing (1) surrounding the bulb, having a shape which corresponds substantially to the outer shape of a candle flame, and made of a light-permeable and light-scattering material, an elongate cavity (19) extending axially through the casing and defining an open lower end (16) for introducing the light bulb into the cavity, a plurality of circumferentially distributed spacing elements (6-13; 23,24) projecting radially inwardly from an inner wall (5) of the casing and abutting an outer surface (14) of the cylindrical portion of the bulb, and an upwardly directed aperture (18) in an upper end (17) of the casing remote from the bulb, said aperture having a diameter less than that of the bulb and substantially less than the open lower end, said spacing elements defining vertical passages for continuous convection air flow upwardly between the bulb and the casing from the open lower end of the cavity to and out through the aperture to dissipate heat generated by the bulb and to thereby cool both the bulb and the casing.

2. A lamp arrangement according to claim 1, wherein the lamp casing is made of a light-permeable and light-scattering plastics material.

3. A lamp arrangement according to claim 1 or claim 2, wherein the wall-thickness of the lamp casing varies along the axial length thereof.

4. A lamp arrangement according to claims 1 or 2, wherein at least a lower portion of the lamp casing is pigmented.

5. A lamp arrangement according to claims 1 or 2, wherein the lamp casing is rotationally symmetrical about its longitudinal axis and comprises a cylindrical part (3) joined with a base of a conical part (4), the open lower end of the cavity coinciding with a bottom of the cylindrical part and having a diameter which is greater than that of the light bulb (15); and the aperture being defined in an apex of the conical part.

6. A lamp arrangement according to claim 5, wherein the spacing elements extend substantially parallel to the longitudinal axis of the casing and comprise continuous flanges.

7. A lamp arrangement according to claim 5, wherein the spacing elements comprise circumferentially and axially distributed circular stubs (23, 24).

8. A lamp arrangement according to claim 7, wherein the cylindrical part of the casing has a greater wall thickness than the conical part.

* * * * *